United States Patent [19]

Oberg

[11] Patent Number: 4,927,085

[45] Date of Patent: May 22, 1990

[54] APPARATUS FOR RECYCLING OIL FILTERS

[76] Inventor: Gordon D. Oberg, 1717 S. Lake Stickney Dr., Lynnwood, Wash. 98207

[21] Appl. No.: 288,321

[22] Filed: Dec. 21, 1988

[51] Int. Cl.[5] ..... B30B 1/32; B02C 19/08

[52] U.S. Cl. ..... 241/36; 241/79; 241/101.2; 241/100; 100/131; 100/902

[58] Field of Search ..... 241/36, 101.2, 79, 100; 100/902, 131, 132

[56] References Cited

U.S. PATENT DOCUMENTS

| | | | |
|---|---|---|---|
| 2,150,812 | 3/1939 | Aukerman | 100/902 X |
| 2,800,159 | 7/1957 | Walsh et al. | 100/902 |
| 3,726,211 | 4/1973 | Gladwin | 100/100 |
| 3,948,164 | 4/1976 | Pobuda et al. | 100/98 R |
| 4,541,332 | 9/1985 | Horansky et al. | 100/902 X |
| 4,554,868 | 11/1985 | Zimmer | 100/229 R |
| 4,570,536 | 2/1986 | Dodd | 100/53 |
| 4,771,686 | 9/1988 | Triantos, Jr. | 100/255 |

FOREIGN PATENT DOCUMENTS

| | | | |
|---|---|---|---|
| 142797 | 9/1982 | Japan | 100/902 |

*Primary Examiner*—Timothy V. Eley

*Attorney, Agent, or Firm*—Ward Brown; Robert W. Beach

[57] ABSTRACT

A specialized crusher has an upright compartment sized to receive an individual oil filter resting on a grate at the bottom. A crusher plate above the filter is guided for vertical sliding movement in the compartment and is moved up and down by a hydraulic jack. Downward movement of the crusher plate collapses the oil filter casing to compact condition and oil contained in it passes through the bottom grate into a spout leading to a receptacle. When a desired pressure has been reached, the jack automatically lifts the crusher plate and the collapsed casing can be removed for salvaging. All components of the apparatus are incorporated in a compact cabinet which can have a bottom drawer for the oil receptacle and a bin in which the collapsed casings can be collected.

6 Claims, 3 Drawing Sheets

APPARATUS FOR RECYCLING OIL FILTERS

BACKGROUND OF THE INVENTION

1. Field of the Invention

The present invention relates to the general fields of waste disposal and scrap salvaging. More specifically, the present invention relates to mechanism for reclaiming oil from used oil filters. Such mechanism also permits safe disposal or salvaging of the metal casings of such filters.

2. Prior Art

Standard replaceable automotive oil filters have metal casings and inner filter elements to trap impurities. Traditionally, spent filters were simply disposed of with other trash. When large numbers are accumulated and disposed of together, it is now recognized that the used filters may damage the environment. Consequently, used oil filters should be handled as hazardous or potentially hazardous waste, which, without the improved system of the present invention, would greatly increase the expenses of disposal. There is no known practical system for recycling used oil filters and for reclaiming the oil trapped in them.

SUMMARY OF THE INVENTION

The principal object of the present invention is to provide a system allowing used oil filters to be converted from hazardous or potentially hazardous waste to profitably recyclable materials.

It is also an object to provide such a system utilizing mechanism of simple and inexpensive but sturdy construction. A related object is to provide such mechanism in a form that is compact and easy to use.

In the preferred embodiment of the present invention, the foregoing objects are accomplished by providing recycling apparatus in the form of a specialized crusher for the used oil filters. In the preferred embodiment, the crusher has an upright compartment sized to receive an individual oil filter resting on a grate at the bottom. A crusher plate above the filter is guided for vertical sliding movement in the upright compartment and is moved up and down by a hydraulic jack. Downward movement of the crusher plate collapses the oil filter casing to compact condition and oil contained in it passes through the bottom grate into a spout leading to a receptacle. When a desired pressure has been reached, the jack automatically lifts the crusher plate and the collapsed casing can be removed for salvaging. Preferably, all components of the apparatus are incorporated in a compact cabinet which can have a bottom drawer for the oil receptacle and a bin in which the collapsed casings can be collected.

DETAILED DESCRIPTION

Figure 1:
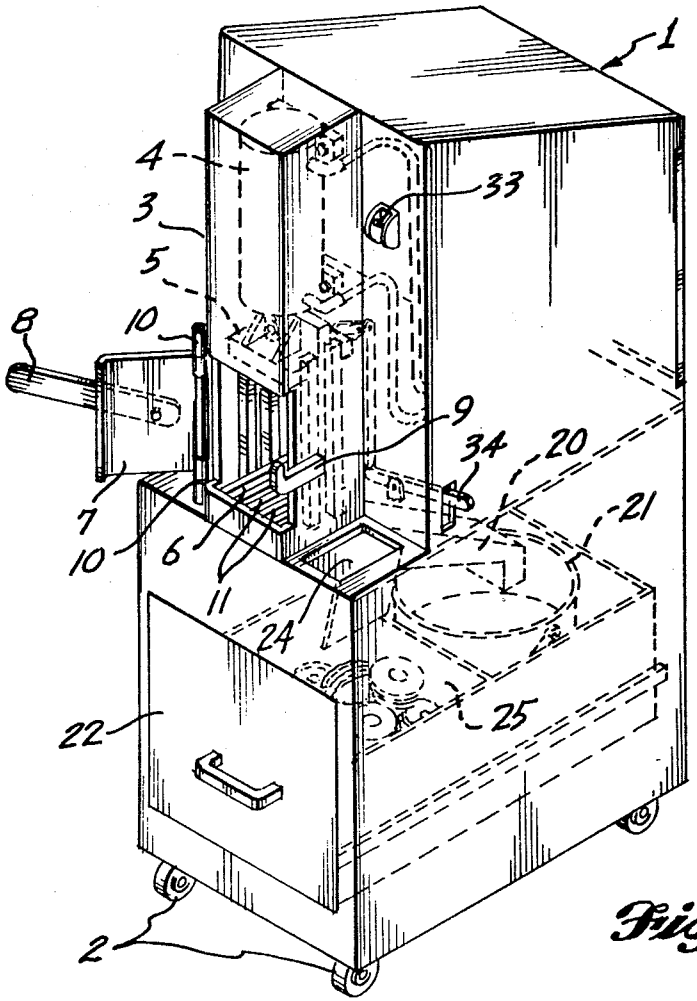
FIG. 1 is a top perspective of apparatus for recycling oil filters in accordance with the present invention.

With reference to FIG. 1, all components of the apparatus for recycling oil filters in accordance with the present invention can be conveniently incorporated in a compact cabinet 1 having casters 2 permitting it to be easily rolled from one location to another. The general procedure is to crush a used oil filter thereby collapsing its metal casing to compact form and forcing essentially all of the oil from it. The oil is recovered from profitable reclamation. The collapsed casing should no longer be considered hazardous or potentially hazardous waste so that it can be disposed of or sold as recyclable scrap.

The cabinet 1 has an upright compartment 3 sized to receive an individual oil filter to be crushed. A fluid pressure jack 4, preferably hydraulic, is mounted in the upper portion of compartment 3 and has a downward-extending reciprocable plunger carrying a horizontal crusher plate 5. With the crusher plate in its raised position shown in FIG. 1, an individual oil filter can be inserted through a front opening 6 closable by a door 7. A sturdy latch to retain the door in its closed position includes a swinging bar 8 mounted on the door 7 and a catch or hook 9 mounted on the side of the compartment 3 opposite the hinges 10 for the door. When inserted into the compartment 3, the oil filter rests on the apertured bottom of the compartment which preferably is in the form of a bottom grate 11 of closely spaced bars extending across the otherwise open bottom of such compartment.

Figure 2:
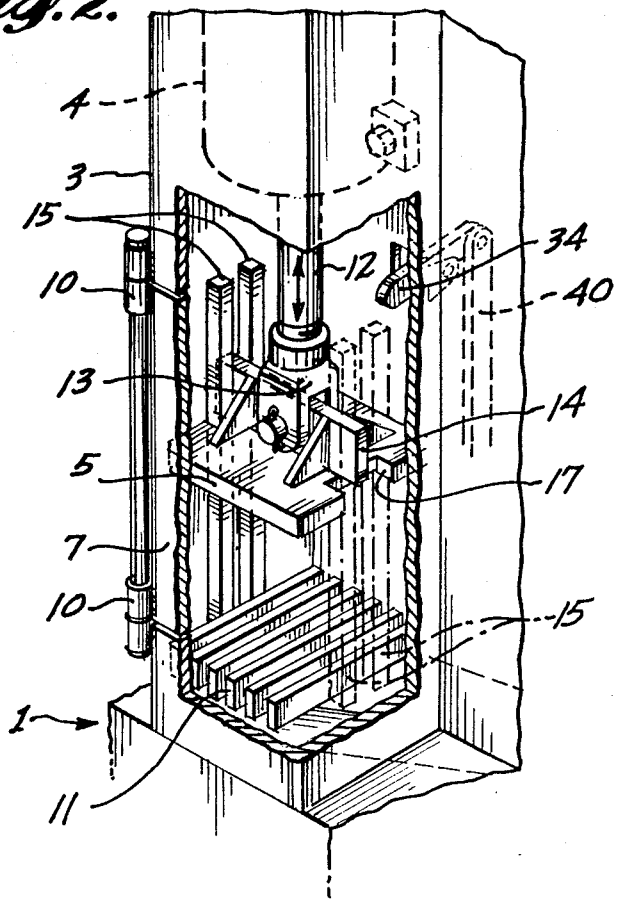
FIG. 2 is an enlarged fragmentary detail perspective of a portion of the apparatus of FIG. 1 with parts broken away.

With reference to FIG. 2, the downward-extending jack plunger 12 is connected to the crusher plate 5 by a clevis 13. Such clevis embraces a central vertical guide plate 14 extending transversely of the compartment 3 and having its opposite end portions fitted between spaced vertical rails 15. The bottom edge of the vertical plate 14 preferably is welded to the top of the horizontal crusher plate 5. Reinforcing gussets 16 can be provided between the two plates for a strong connection.

Opposite sides of the crusher plate 5 have rectangular notches 17. Each notch embraces the upright rails 15 at its side. The rails 15 in combination with the central vertical plate 14 fitted between them and the edges of the notches 17 of the crusher plate 5 guide the plate for smooth vertical sliding despite the considerable resistance of an oil filter being crushed.

With reference to FIG. 1, during crushing of the filter by extension of the jack plunger to force the crusher plate 5 downward, oil from the interior of the filter casing passes between the bars of the grate 11 into an elongated spout 20. Such spout can lead to a receptacle 21 in a bottom drawer 22 of the cabinet 1. When the crushing operation has been completed, door 7 of the crushing compartment 3 can be opened and the collapsed casing of the oil filter can be dropped through an opening or chute 24 which leads to a bin 25 of the drawer 22 adjacent to the compartment for the oil receptacle 21.

Figure 3:
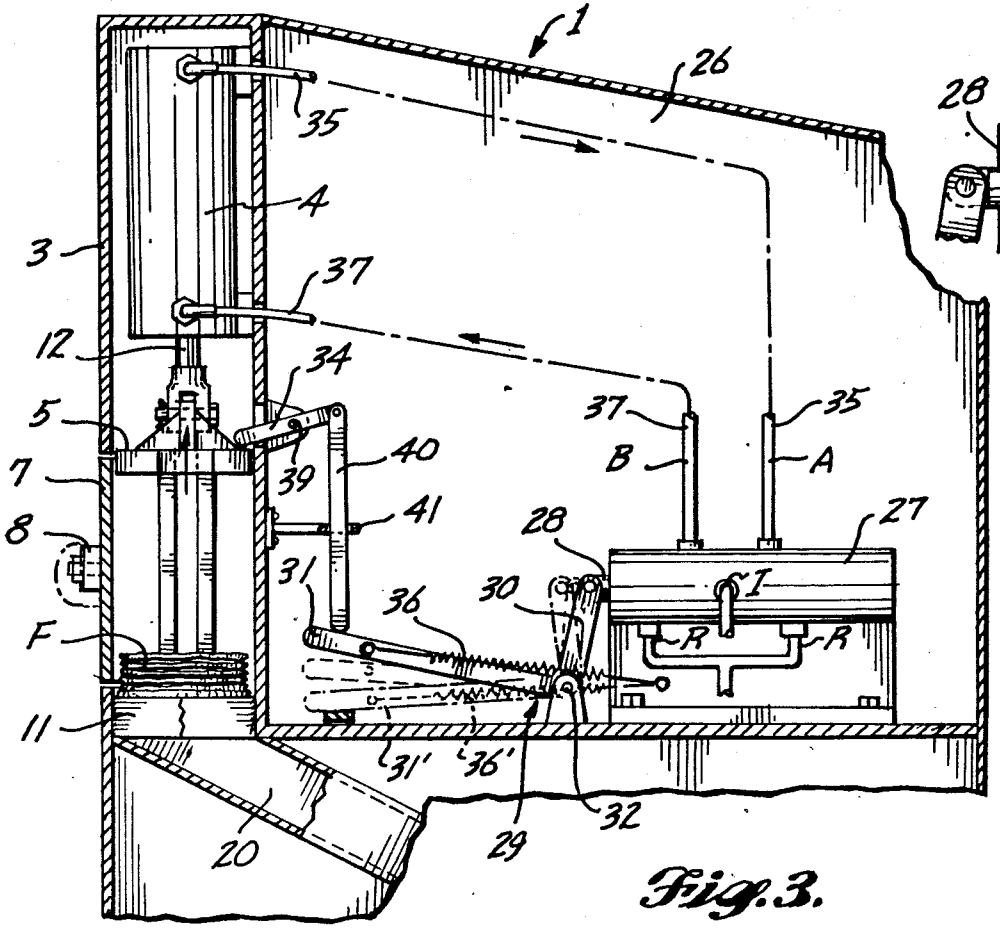
FIG. 3 is a somewhat diagrammatic side elevation of the apparatus of FIG. 1 with parts broken away.

With reference to FIG. 3, the cabinet 1 can have an upper rear compartment 26 for the mechanism controlling operation of the hydraulic jack 4. Such compartment can contain a conventional pump (not shown) and a directional and pressure control valve 27 including an internal reciprocating spool or piston 28. As shown schematically in FIG. 4, valve 27 has an inlet port I for hydraulic liquid from the pump, alternative outlet ports A and B connected to the opposite ends of the double-acting jack 4 and return ports R for return of hydraulic liquid to the pump reservoir.

Figure 4:
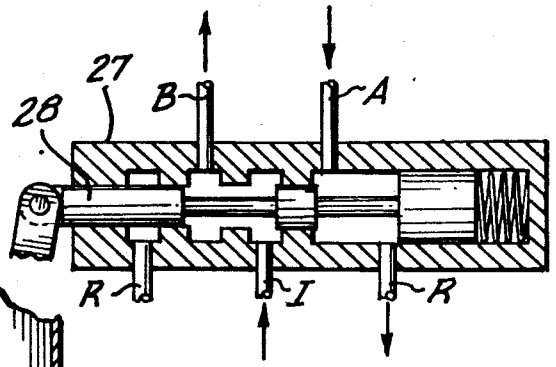
FIG. 4 is a very diagrammatic longitudinal section of a representative component of the apparatus in accordance with the present invention, namely, a control valve.
Figure 6:
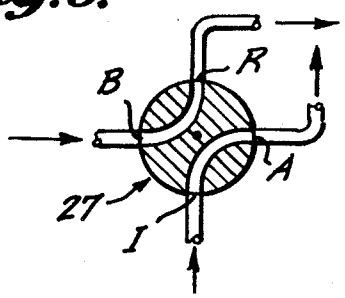
FIG. 6 and FIG. 7 are schematic diagrams representing different conditions of the control valve.
Figure 7:
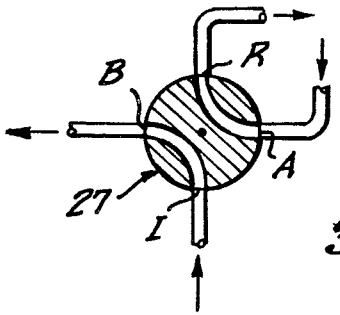
Figure 5:
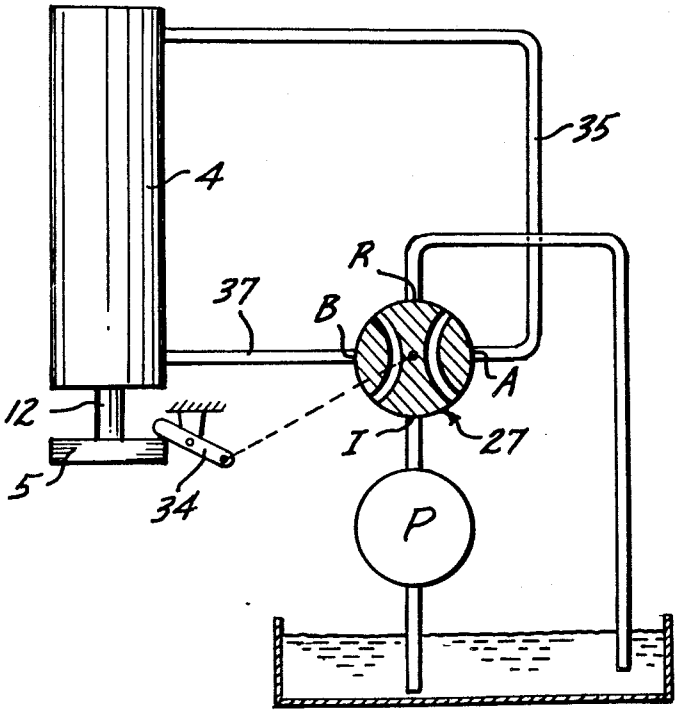
FIG. 5 is a schematic hydraulic circuit diagram of the apparatus for recycling oil filters in accordance with the present invention, including the control valve.

The valve piston 28 has three operating positions represented diagrammatically in FIGS. 5, 6 and 7. In the central neutral position of the valve represented in FIG. 5, the pump P and its reservoir are cut off from the hydraulic jack 4. In the condition represented in FIG. 6, corresponding to the leftmost shifted position of the piston 28 as shown in FIGS. 3 and 4, port I from the pump is in communication with port A of the valve leading to the top of the jack 4 so as to extend the jack plunger and force the crusher plate downward, while port B from the bottom of the jack is connected to a port R of the valve for return of hydraulic liquid to the pump reservoir. In the condition represented in FIG. 7, corresponding to the rightmost shifted position of the piston 28 as shown in FIGS. 3 and 4, port I from the pump is connected to port B of the valve leading to the bottom of the jack 4 so as to retract the jack plunger and raise the crusher plate, while port A of the valve from the top of the jack is connected to port R leading to the pump reservoir.

With reference to FIG. 3, the position of the valve piston 28 is controlled by a mechanical linkage including a bell crank 29. Piston 28 is connected to the upper end portion of an upright leg 30 of the bell crank. The other leg 31 extends generally horizontally from the bell crank pivot 32 away from the valve 27. With the pump actuated, such as by the switch 33 shown in FIG. 1, the swinging end portion of the horizontal leg 31 of bell crank 29 is manually forced down by manipulation of the operating lever 34 (shown in FIG. 1). An over center spring 36 retains the bell crank with its horizontal leg 31 in the downward swung position. Such action moves the valve piston 28 to its leftmost position corresponding to the condition shown in FIG. 6 such that hydraulic liquid under pressure is supplied to port A and through a conduit 35 to the top of the hydraulic jack so as to extend the plunger, force the crusher plate 5 down and collapse the oil filter F fitted in the bottom of the upright crusher compartment 3.

In addition to operating as a directional control valve, valve 27 also operates as a pressure control valve. When a desired pressure is exceeded at port A, such as 2,000 psi, piston 28 is automatically biased to the right toward its central neutral position. In the preferred embodiment, movement of piston 28 to the right toward its neutral position changes the position of the horizontal leg 31 of bell crank 29 sufficiently that the over center spring 36 biases such leg upward, thereby forcing the piston 28 past its neutral position to its rightmost position illustrated in solid lines in FIGS. 3 and 4. Such position corresponds to the condition shown in FIG. 7 in which hydraulic liquid under pressure from the jack is supplied to port B and through a conduit 37 to the bottom of the jack cylinder which automatically causes the jack plunger to retract, thereby raising the pressure plate.

As the plunger retracts, eventually the condition shown in solid lines in FIG. 3 is reached where the top of the crusher plate engages the inner end portion of a sensing lever 34′ which portion protrudes into the crushing compartment 3 in the path of movement of the crusher plate. Lever 34′ is pivotally connected to a side of the compartment. At the opposite side of its pivot 39, such lever is connected to a vertical link 40 extending downward through a guide eye 41. Vertical link 40 has a bottom end in alignment with the horizontal leg 31 of bell crank 29. As the pressure plate continues to move upward, lever 34′ is rotated clockwise as seen in FIG. 3, forcing the vertical link 40 and, consequently, the horizontal leg 31 of the bell crank downward. Such movement forces the valve piston 28 to the left until it reaches its neutral position, at which point the hydraulic jack is cut off from the pump. Consequently, the crusher plate will stop its upward travel ready for insertion of the next oil filter. The collapsed filter can be removed from the door opening and deposited in the opening or chute 24 leading to the bin 25 of drawer 22.

I claim:

1. Apparatus for recycling an oil filter comprising a housing having an elongated compartment sized to receive the oil filter and having a first end adapted to engage such filter, a crusher plate mounted for movement lengthwise of said compartment toward and away from said first end, and means for moving said crusher plate in said compartment with sufficient force to collapse such filter, said crusher plate moving means including a fluid pressure jack connected to said crusher plate and control means for supplying fluid under pressure to said fluid pressure jack, said control means including a directional control valve actuatable to supply fluid under pressure to said jack so as to effect movement of said crusher plate toward said first end of said compartment and for moving said plate away from such first end automatically when force in excess of a predetermined force is applied against the oil filter by said crusher plate, said control means further including means for sensing the position of said crusher plate as it is moved away from said first end of said compartment and for automatically cutting off the supply of fluid under pressure to said hydraulic jack so as to stop such movement of said crusher plate when it reaches a predetermined position.

2. The apparatus defined in claim 1, in which the directional control valve includes a reciprocating internal piston member and the sensing means includes a mechanical linkage connected to said piston.

3. The apparatus defined in claim 1, in which the directional control valve includes a reciprocable internal piston, and including a mechanical linkage connected to said piston and having a bell crank connected to an end portion of said piston and a spring biasing said bell crank.

4. The apparatus defined in claim 1, in which the sensing means includes a member having a portion protruding into the compartment in the path of movement of the crusher plate, means mounting said member for movement by engagement against the crusher plate as it is moved away from the first end of the compartment and means actuated by movement of said member to cut off the supply of fluid under pressure to the jack when the crusher plate reaches the predetermined position.

5. The apparatus defined in claim 4, in which the member is a lever pivotally mounted on the housing.

6. Apparatus for recycling an oil filter comprising a housing having an elongated compartment sized to receive the oil filter and having a first end adapted to engage such filter, means mounting said crusher plate for movement lengthwise of said compartment toward and away from said first end, and means for moving said crusher plate in said compartment with sufficient force to collapse said filter, said mounting means including two substantially parallel rails elongated lengthwise of the compartment in the direction of movement of said crusher plate, said two rails being spaced apart forming a space therebetween, said crusher plate having a notch with opposite edges movable along the opposite sides of said two rails, respectively, and a central guide member received in the space between said two rails.

* * * * *